United States Patent [19]

Bellocci et al.

[11] Patent Number: 4,491,303

[45] Date of Patent: Jan. 1, 1985

[54] LOADING METHOD AND INSTALLATION FOR A METAL ALLOY FOUNDING FURNACE TO SUPPLY FOUNDRY MOLDS

[75] Inventors: Rio Bellocci, Pont-a-Mousson; Joël Pamart, Chalon, both of France

[73] Assignee: Pont-a-Mousson S.A., Nancy, France

[21] Appl. No.: 534,867

[22] Filed: Sep. 22, 1983

[30] Foreign Application Priority Data

Sep. 28, 1982 [FR] France ..... 82 16427

[51] Int. Cl.[3] ..... B66C 17/08

[52] U.S. Cl. ..... 266/114; 75/10 R; 266/120

[58] Field of Search ..... 75/10 R, 129, 130 R; 266/120, 114; 213/18 R, 18 SC

[56] References Cited

U.S. PATENT DOCUMENTS

| | | | |
|---|---|---|---|
| 3,396,777 | 8/1968 | Reding | 75/130 R |
| 3,854,939 | 12/1974 | Mezoff | 75/130 R |
| 4,060,407 | 11/1977 | Jackman | 75/130 R |
| 4,299,624 | 11/1981 | Miller | 75/130 R |

*Primary Examiner*—Peter D. Rosenberg

*Attorney, Agent, or Firm*—Sughrue, Mion, Zinn, Macpeak, and Seas

[57] ABSTRACT

To fast load a metal alloy casting furnace 1 at a high casting temperature to supply foundry molds at an industrial pace, a liquid portion of the overall load is first introduced deep inside the furnace with a device L comprising a telescopic channel 30–31. A solid portion of the remaining overall load is then introduced with a device S comprising a tilting pusher-equipped channel 20 disposed below a static hopper 15. The liquid part of the load includes alloy compounds which are the least sensitive to oxidation; the solid part includes compounds which are highly sensitive to oxidation.

9 Claims, 13 Drawing Figures

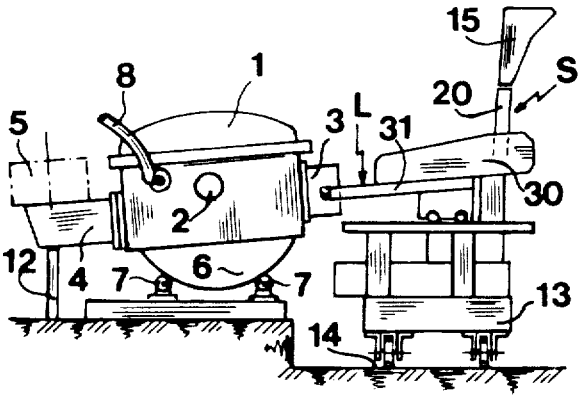
Fig. 1
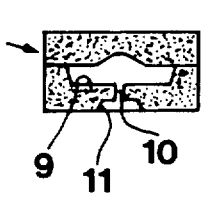
Fig. 2
Fig. 3
Fig. 4
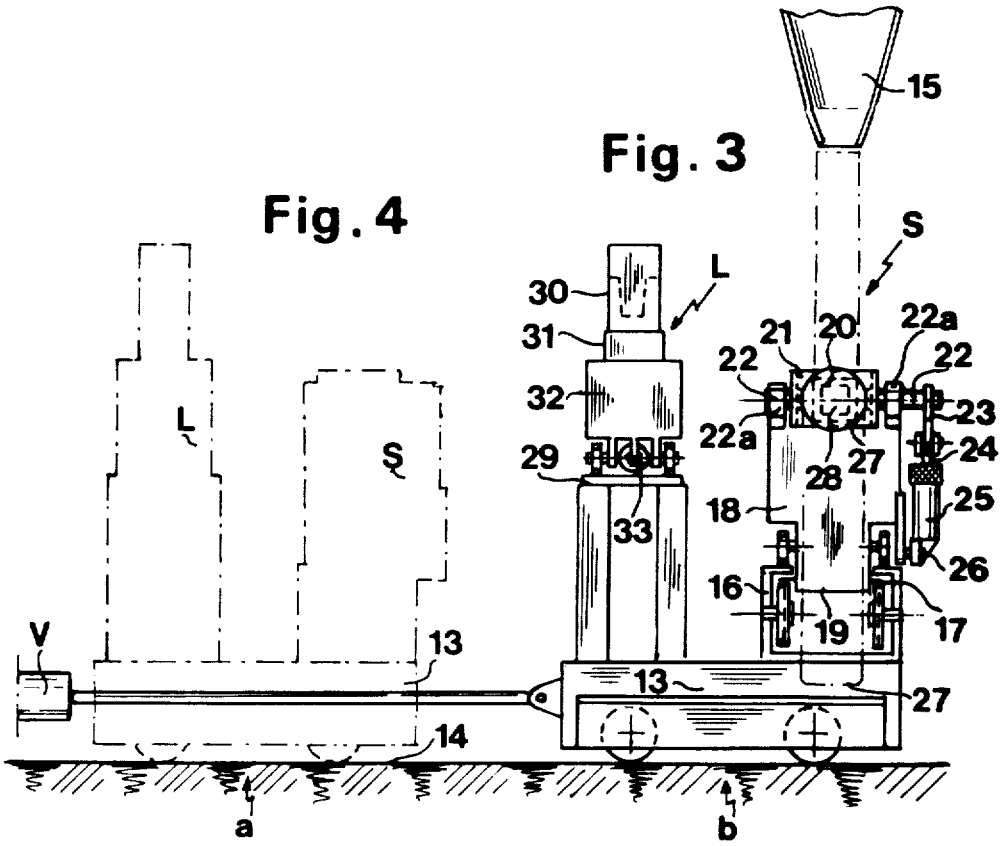

1
L
3
30
31
32
33
a
b
29
6
7
13
14
14

1
3
31
30
P
32
33
L
6
29
c
7
13

LOADING METHOD AND INSTALLATION FOR A METAL ALLOY FOUNDING FURNACE TO SUPPLY FOUNDRY MOLDS

BACKGROUND OF THE INVENTION

This invention pertains to the loading of an electric furnace for founding to a high casting temperature metal alloys which are highly subject to oxidizing in order to supply foundry molds. In particular, it pertains to the loading of a graphite rod electric furnace, with openings sealed shut, this furnace being filled with pressurized argon that is monitored above the metal alloy bath by an inner argon current.

This furnace, which is equipped with a casting channel that can be directly connected to the supply orifice of a foundry mold, is of the tilting kind so as to vary the slope of the casting channel between a metal alloy receiving position for reheating and founding and a mold supply position for transferring the metal alloy from the furnace to the molding cavity.

The previously mentioned metal alloys to be made in such a furnace are those which are cast at a temperature that is at least equal to 1,400° C. and that are extremely sensitive to oxidation. For instance, they are iron, nickel, chromium, or iron, chromium nickel, cobalt, austenite-based super-alloys or nickel-based or cobalt-based super-alloys, which contain less than 20% iron, or for instance refractory nickel, chromium, iron-based alloyed steel with more iron than the super-alloys, or ordinary steel. Super-alloys and refractory steel or strongly alloyed steel are used to mold parts designed to resist high temperatures (for metallurgical furnaces, mechanical, the aerospace industry, etc.).

Such a furnace undertakes slow founding, by radiating heat from its graphite rod. It was selected for founding such alloys over more popular founding devices which are more conductive to quick founding, such as induction furnaces or at least solid or liquid fuel furnaces, because of its ability to produce repeatedly and reproducibly metal alloys, especially well-defined super-alloys, by avoiding any pollution, especially air pollution. It also avoids undesirable solid, liquid or gaseous elements such as those which common furnaces heated with solid or liquid fuel might introduce inside a metal bath.

However, the industrial need to supply foundry molds with liquid metal at a fast rate is not very compatible with the use of such a slow founding furnace. Indeed, such a furnace, with a limited founding capacity, 500 kg for instance, requires several hours to found such a quantity of solid metal alloys introduced in the shape of ingots, and it is felt that this furnace is unusable in industrial applications.

SUMMARY OF THE INVENTION

Therefore, the invention is designed to resolve the problem of using such a furnace for industrial application, in order to supply foundry molds at a high rate. This founding furnace is designed to produce liquid metal alloys of special composition without time constraints in manufacturing.

The invention pertains to a loading method for a graphite rod electric founding furnace which makes it possible to resolve this problem. The method is characterized in that we first load the part of the overall load in liquid form which includes the metal alloy compounds that are the least sensitive to oxidation and this load is first introduced deep inside the furnace. This liquid load is founded inside an auxiliary rapid founding furnace like an induction furnace. Then the remainder of the overall load, which includes the compounds of the metal alloy that are the most sensitive to oxidation, are introduced into the furnace in solid form. The weight ratio between solid load and liquid load is a fraction slightly smaller than 1.

When a nickel or chromium-based alloy is founded, chromium comprises most of the solid load because it is sensitive to oxidation in its liquid state.

With this method, the solid load that is mixed into the liquid load inside the furnace is founded not only by the heat radiated from the graphite rod but also by the heat from the bath that surrounds the solid load so that overall founding is much faster than with simple radiation. As a result, such a furnace, thus loaded, can supply foundry molds at an industrial pace.

The invention is also designed to resolve the question of loading speed in order to prevent oxidation in the presence of air and to resolve the problem of glutting. It further occupies minimal floor area.

To this end, the invention pertains to a facility for implementing such a method. The loading facility includes crosswise on the same mobile transfer carrier, side-by-side and parallel, both a device with a liquid load introduction channel and a device with a solid load introduction channel. Both these channels are located parallel to the axis of introducing solid and liquid loads through a loading orifice of the furnace and each channel is mobile in a translational motion that is parallel to this axis. This axis is the line of the vertical plane of symmetry of the furnace loading orifice.

In the event that it is not possible to place the fragmented solid load vertically into the furnace, through gravity, the solid load channel that is either horizontal or slightly sloped is equipped with a pusher for the solid mobile load in a translational motion along the entire length of the channel for introducing the load inside the furnace. This arrangement makes it possible not only to overcome the friction of the load against the channel but also to introduce quickly a large solid load.

When the available location does not make it possible to place a long slightly sloping channel, which is mobile along the axis for introducing a load, in a position between the two previously mentioned positions, and when the location is also too restrictive to permit the housing of a channel and its pusher more or less horizontally and end-to-end according to the load introduction axis, the invention also plans both means for the liquid load channel and for the solid load channel so as to provide a solution to the question of lack of space.

According to a characteristic of the invention, a slightly sloping channel for introducing a liquid load coming from an auxiliary neighboring founding furnace includes a static upward liquid metal alloy receiving element and a downward casting end element which is mobile and contractible in relation to the upward static element, the channel being telescopic.

According to another characteristic of the invention, the channel which is equipped with a pusher tilts between a vertical solid load receiving position and a more or less horizontal position to transfer that load inside the furnace with the pusher.

Thus, we advantageously use gravity in order to introduce the solid load into the pusher-equipped channel, in a more or less vertical position, and we use the pusher to introduce this load inside the furnace when the channel is in a more or less horizontal position. The channel unit with its pusher can be compared to a tilting gun that we load into the muzzle in a similar vertical position and that we unload (for the placement operation) by actuating the pusher, on the side of the breech, after tilting into a firing position.

With this apparatus, furnace loading is hastened because the liquid load is poured onto a short length of channel sheltered from air that is located between the tilting induction furnace and the loading orifice of the tilting rod furnace, and that, after crosswise translation of the transfer carrier which bears the two channels, the solid is pushed inside the furnace with enough force of the load to be quickly discharged from the channel into the furnace.

Finally, loading requires a minimum of clutter on the factory floor between the induction furnace and rod furnace since, in the load receiving position, the solid load pusher channel is in a vertically tilted position, while the liquid load telescopic channel has a large portion of its telescopic length inserted inside the furnace. Furthermore, after introducing the loads into the furnace, the static upward element of the liquid load telescopic channel is outside of the furnace whereas the channel or gun of the solid load, in a more or less horizontal position, only displays a short length outside of the furnace.

Other characteristics and advantages will emerge during the description that follows.

BRIEF DESCRIPTION OF THE DRAWINGS

In the attached drawings, which are provided as an illustration:

FIG. 1 is a schematic view at a small scale on the loading facility for an electric, tilting furnace designed to found oxidative metal alloys, according to the invention;

FIG. 2 is a sectional schematic view of a foundry mold designed to be supplied with oxidative metal alloys by that electric furnace;

FIG. 3 is a crosswise schematic view, at a larger scale than FIG. 1, of a transfer carrier which bears the two loading channels, one for solid loads, the other for the liquid load in the solid load furnace placement position;

FIG. 4 is a view which corresponds to FIG. 3 and that illustrates the outline of the transfer carrier which bears the two loading channels, one for solid loads, the other for the liquid load in the solid load furnace placement position (withdrawn and rest position);

DETAILED DESCRIPTION OF THE INVENTION

Figure 5:
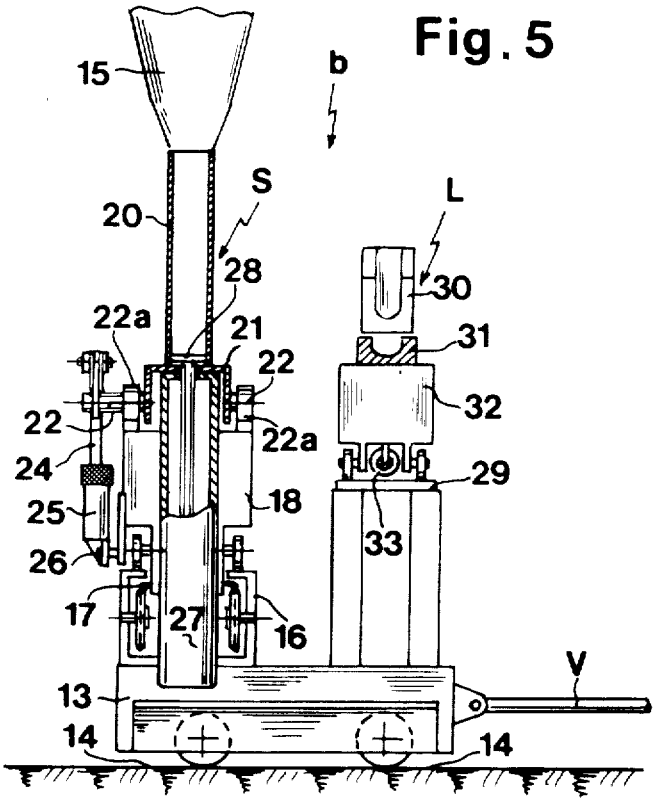
FIG. 5 is a crosswise view of the transfer carrier similar to FIG. 3 but in the opposing direction, the solid load channel being in a more or less vertical position for receiving its load.

According to the example of FIGS. 1 and 2, the invention is applied to the loading of an electric founding furnace 1 having a graphite rod 2, with a loading opening 3, that can be hermetically sealed. The furnace has a casting channel 4, opposite the loading opening 3, to fill a mold 5 depicted with dotted lines in FIG. 1 and sectionally in FIG. 2, this mold being applied in sealed fashion to the casting orifice of the channel 4. The furnace 1 is borne by a circle ark cradle 6 on support rollers 7 of which at least one is driven in order to make the furnace 1 tilt and to allow the slope of the casting channel 4 to vary. The furnace 1 is of the horizontal kind and possesses an inner capacity of about several hundred kilograms of liquid metal alloy, which is placed below an inert gas atmosphere under pressure, argon for example, that is monitored by an inlet duct 8.

The mold 5 to be supplied for example with oxidative liquid metal alloy is of the kind made from sand that agglutinates with a binding agent. But it could also be a foundry mask or a metal mold, i.e., a molding shell. The mold 5 includes a molding cavity 9, an ascending casting duct 10 and a casting orifice 11 or supply orifice at the bottom of the duct 10 and on the lower side of the mold 5. The supply orifice 11 of the mold 5 is designed to be applied in sealed fashion, with some force, against the corresponding casting orifice of the casting channel 4 which is supported by a crutch 12, the height of which is adjusted by known means which are not depicted.

In this example, the mold 5 is recessed, in that the molding cavity 9 does not lead into the upper side of the mold 5 and neither does it communicate with it through the stacks that are known as risers. However, the mold 5 might not be recessed, or it might include risers.

In conformity with the invention, the founding furnace 1 is filled with materials composed of the compounds of a metal alloy to be founded and subsequently loaded into the mold 5. These materials are loaded into the furnace 1 both as a solid load and as a liquid load.

To this end, a transfer carrier 13 is mobile along tracks 14, that are orthogonal to the general direction of the casting channel 4, and is located on the side of the furnace 1 with the loading orifice 3. The carrier 13 supports a solid loading device S used for introducing solid loads and a liquid loading device L used for introducing the liquid load.

Figure 6:
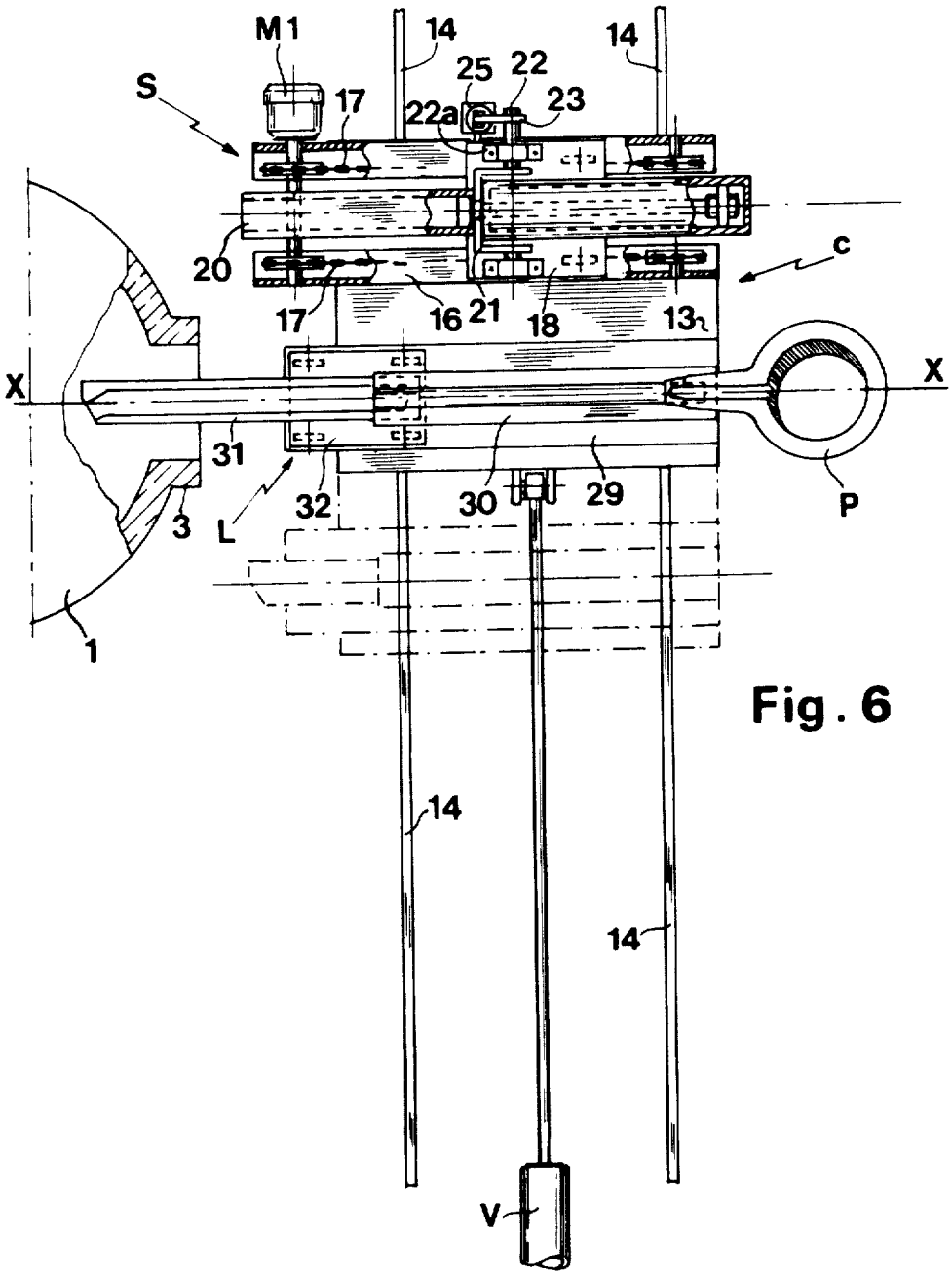
FIG. 6 is a plane schematic view of the transfer carrier in a position for pouring the liquid load into the founding furnace.
Figure 7:
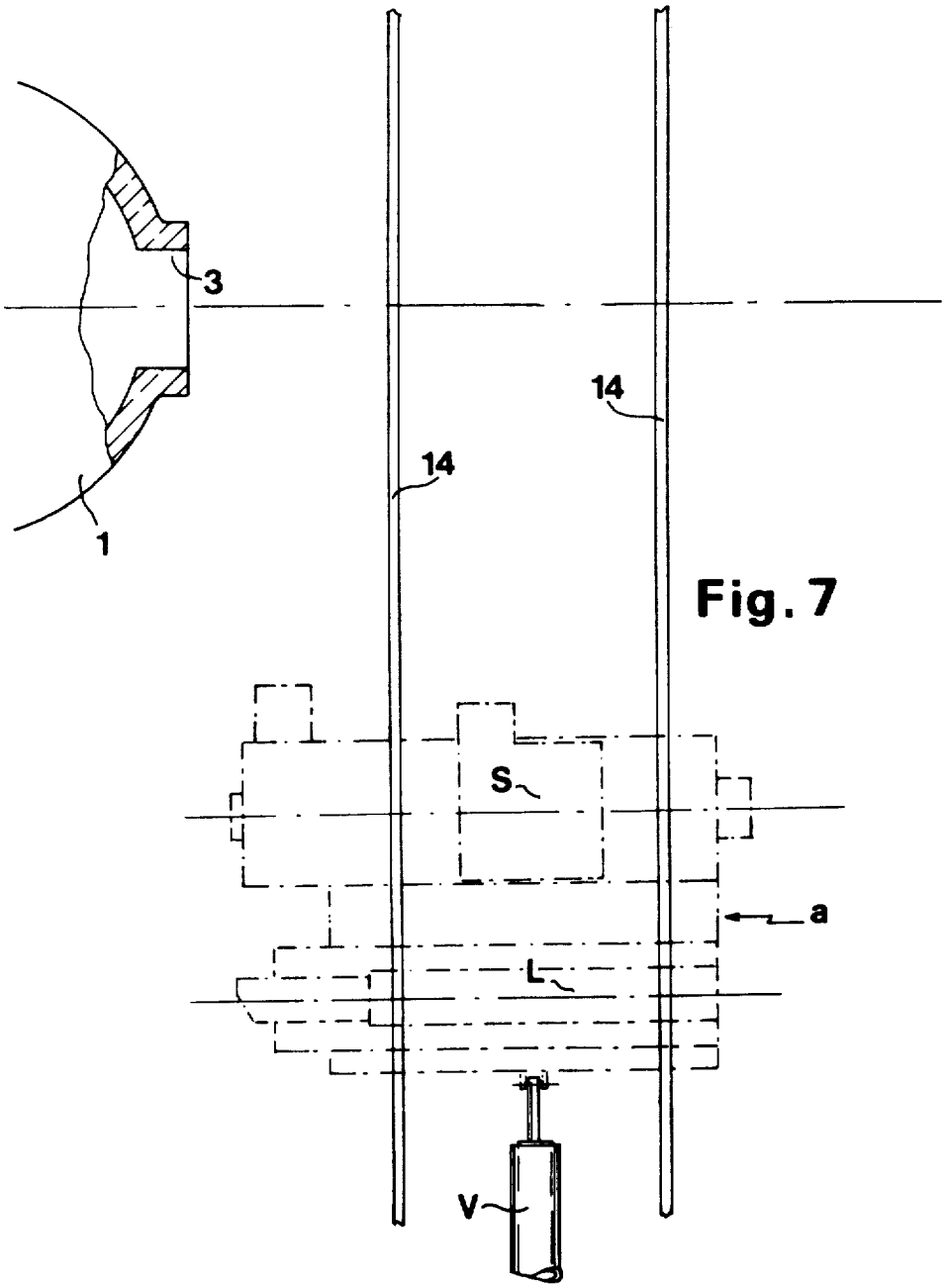
FIG. 7 is a view which corresponds to FIG. 5 that illustrates the outline of the transfer carrier in a crosswise withdrawn and rest position in relation to the founding furnace.
Figure 12:
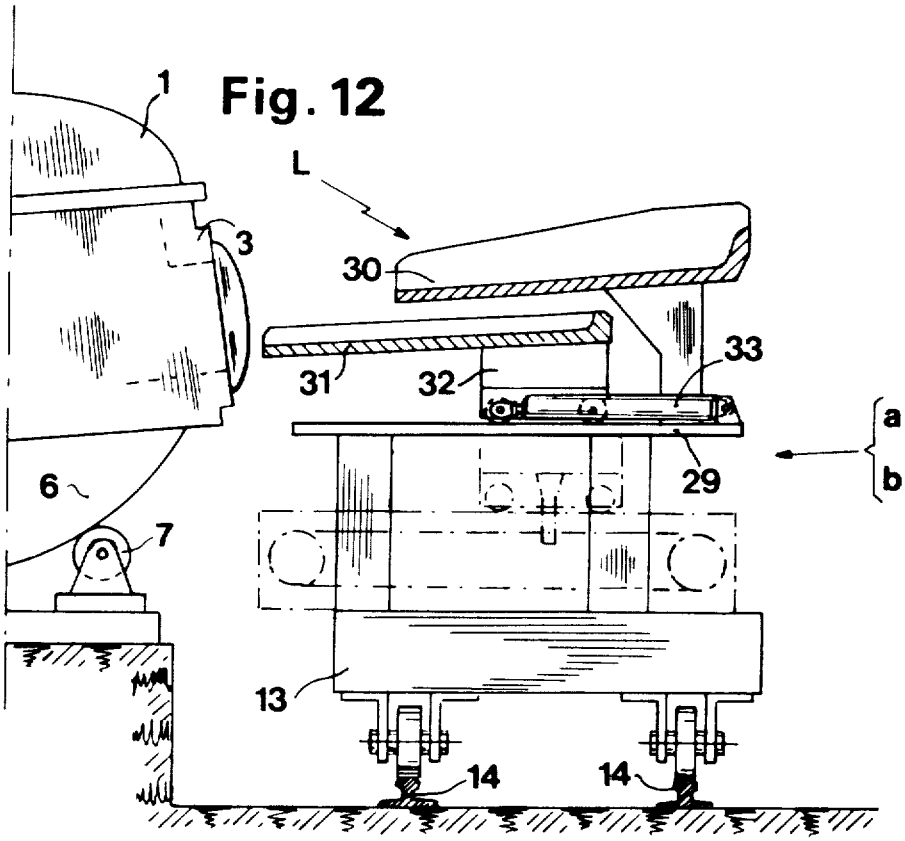
FIGS. 12 and 13 are partial schematic views from above of the contractible telescopic channel which is respectively in the contracted rest position and in the extended position both to receive and to pour the liquid load into the founding furnace.
Figure 13:
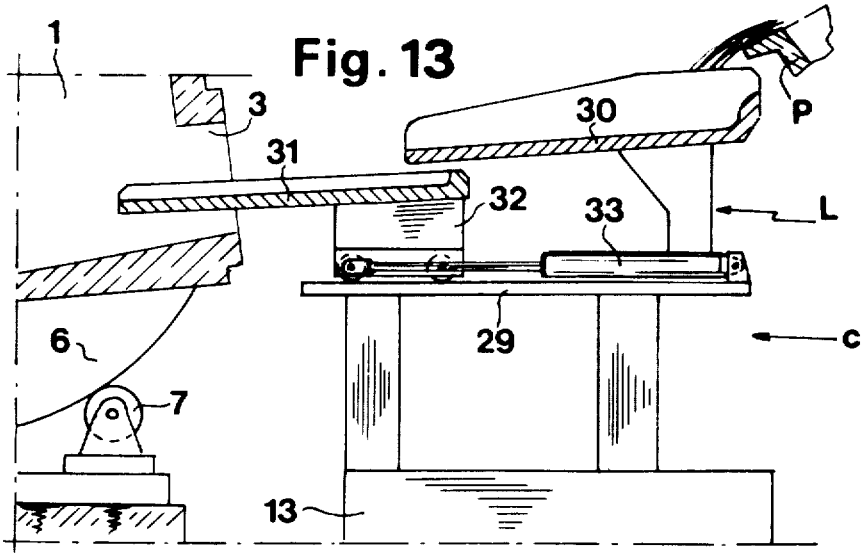

The transfer carrier 13 can assume three major positions in relation to the founding furnace 1, by movement along the tracks 14;

(a) position for withdrawal and rest (denoted by a dotted line in FIGS. 4 and 7 and by a solid line in FIG. 12);

(b) position for receiving solid loads, for preplacement and placement of the loads into the furnace (illustrated in FIGS. 3, 5, 8, 10 and 12, and by a dotted line in FIG. 6), when the liquid loading device is withdrawn;

(c) position in which the liquid loading device L is in its loading position and the solid loading device S is in the withdrawn position (illustrated in FIGS. 6 and 13).

SOLID LOADING DEVICE

The solid loading device S includes a static hopper 15 for introducing solid loads by gravity feed into a mobile channel that will be described later. It also includes mobile transfer means for those solid loads towards the founding furnace 1, for receiving those solid loads from the static hopper 15 and for putting those loads into the founding furnace 1. The hopper 15 is affixed to a platform (FIG. 9) away from the founding furnace 1 but the hopper 15 has a vertical symmetry plane which is the same as that of the loading opening 3 of the founding furnace 1. This plane follows the X—X axis of FIG. 8.

The transfer carrier 13 bears a support and rolling car 16 which is orthogonal to the tracks 14 of the transfer carrier 13. In other words, the car 16 has a vertical symmetry plane which, when the transfer carrier 13 is in the b position for placing a solid load into a furnace, is the same as that of the loading opening 3 of the furnace 1 and follows the axis X—X of FIG. 8.

Figure 8:
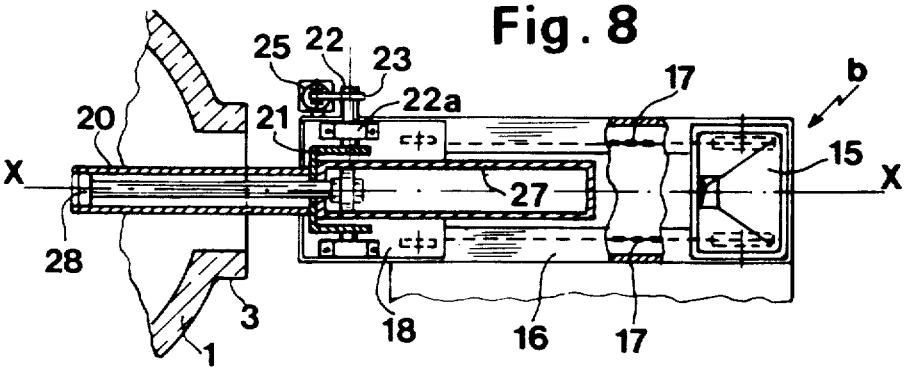
FIG. 8 is a partial plane view which corresponds to FIG. 5 of the solid load channel in a position for placing a solid load into the founding furnace.

The car 16 carries a pair of continuous chains 17 which are parallel to the previously mentioned vertical symmetry plane that are driven by a motor Ml (FIG. 8). The car carries a secondary car 18 which rolls on car 16 in a direction parallel to the vertical symmetry plane. The secondary car 18 includes an attachment arm 19 for the chains 17 (FIGS. 3, 10 and 11) so that the chains 17 act as driving means for bi-directional motion of the secondary car 18 (approach direction towards the loading orifice 3 for introducing the solid load and a withdrawn direction for removal from the loading orifice 3). The secondary car 18 carries a tubular channel 20 or loading channel which is rectangular in a crosswise section and which is rotatable and that can take up two positions, one position more or less vertical below the hopper 15 (FIGS. 5 and 9) to receive the solid load, the other position horizontal for transferring the solid load inside the founding furnace 1 (FIGS. 3, 8, 10 and 11).

To this end, the channel 20, which is extended in a direction which is orthogonal to the tracks 14 of the transfer carrier 13 and parallel to the planes of the continuous chains 17, includes a downward end which is open on the side of the loading orifice 3 and the other upward end that is closed by a pusher 28 which acts as a bottom for the channel 20. On the side of the sealed end or bottom, the channel 20 is attached to a cover 21 that is rotatable about a horizontal axis spindle 22 on bearings **22*a* (FIGS. 3, 5, 6, 8, 9, 10 and 11). A crank 23 to rotate the channel 20 about the spindle 22 is attached to the cover 21. The crank is actuated in a rotational motion by the piston rod 24 of a jack 25 which is rotatable about an arm 26 on the support and rolling car 18**.

To effect the axial extension of the loading channel 20, a long jack 27 is mounted onto the car 16. A piston rod of the jack 27 carries a pusher 28 having an area which corresponds to the rectangular cross-section of the interior of the loading channel 20. Its area may be slightly smaller than the section in order to freely move therethrough. The pusher 28 pushes the contents of the channel 20 towards the loading orifice 3 of the furnace 1 starting from an initial position where the pusher 28 acts as the bottom for the loading channel 20 when it is in a more or less vertical position for receiving the solid load from the hopper 15.

Figure 9:
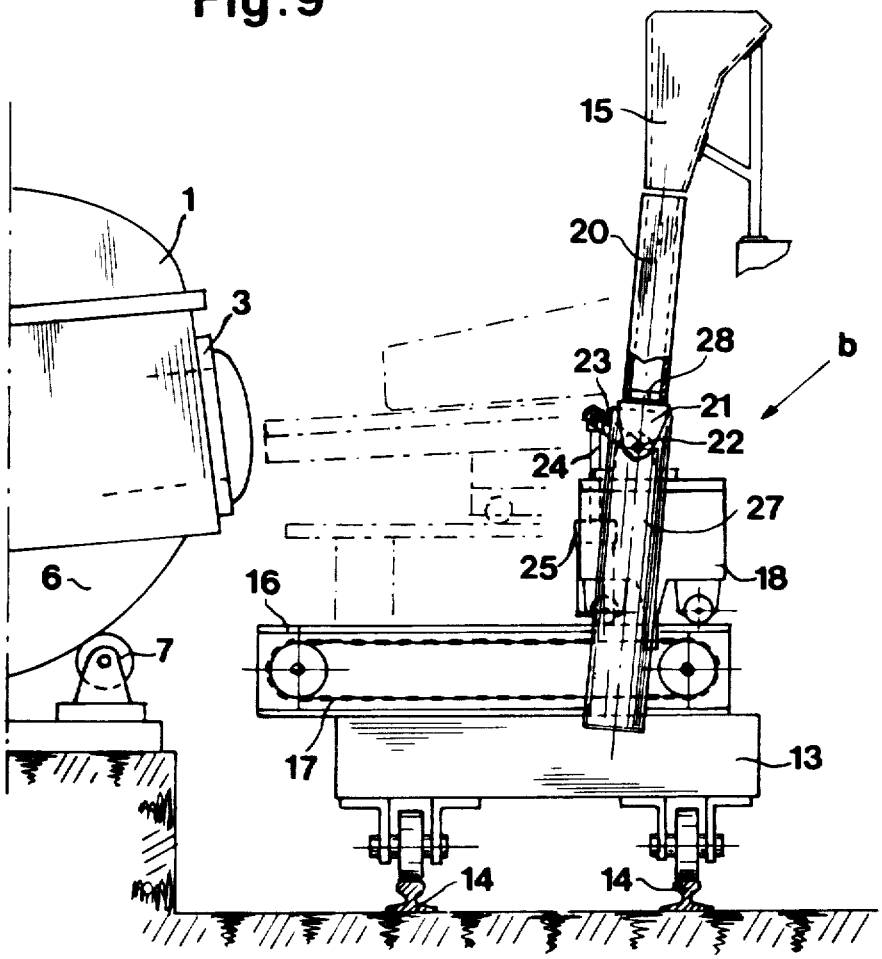
FIG. 9 is a partial schematic view, from above, of the transfer carrier and the solid load channel in a vertical solid load receiving position, prior to furnace placement.

In this arrangement the jack 27 is attached to the channel 20 and to the cover 21 at their spindle 22 on bearings **22*a* so that they rotate between a slightly sloped horizontal position descending towards the loading orifice 3 (FIGS. 3, 6, 8, 10 and 11) and a vertical position under the hopper 15 (FIGS. 5 and 9**).

Liquid Loading Device

The transfer carrier 13 carries a second support and rolling car 29 which has a vertical symmetry plane that is orthogonal to the tracks 14 of the transfer carrier 13, and which is parallel with the vertical symmetry plane of the loading orifice 3 along the line X—X in FIG. 6. On the second car 29, there is mounted a two-part telescoping channel, having a static upward part and a mobile downward part.

The static part is a spillway 30 affixed to the car 29. The mobile part is the channel proper or the casting trough 31 which is placed at a level lower than the spillway 30, on a second mobile secondary car 32 on the car 29 in a direction orthogonal to tracks 14 of the transfer carrier 13 and parallel to the vertical symmetry plane of the loading orifice 3. The casting channel or trough 31 is long enough to introduce a liquid load of metal or alloy from the spillway 30 which receives it from a ladle P of another founding furnace. The ladle P can be advantageously replaced by a tilting induction furnace. The length of the channel 31 is limited in order to permit its withdrawal from the founding furnace 1 in view of the available space on the transfer carrier 13. The second secondary car 32 which carries the channel 31 is actuated in translational motion by a jack 33 which is rotatable on the second rolling and support car 29 upon which the second secondary car 32 rolls. The casting trough 31 can take up two extreme positions. One position is contracted outside of the founding furnace 1, the trough 31 then being mostly below the spillway 30 (FIG. 12). The other position is extended for casting wherein the trough 31 displays an upward end below and behind the spilling edge of the static spillway 30 and another end deep inside the founding furnace 1.

In the contracted or resting position, the trough 31 is sufficiently removed to permit the transfer carrier 13 to move crosswise along the tracks 14. The trough 31 preferably possesses a slight slope from the horizontal, this slope being downward towards the founding furnace 1. The extended or casting position is illustrated in FIG. 13.

Figure 10:
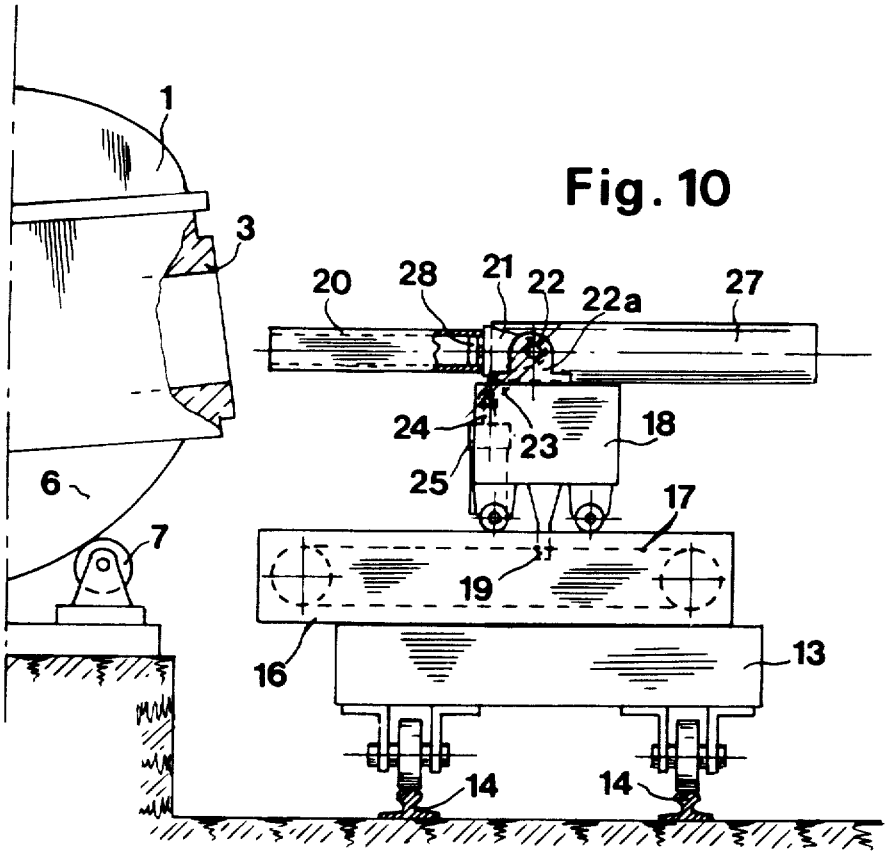
FIGS. 10 and 11 are partial schematic views from above which correspond to FIG. 8 of the solid load channel in a horizontal position respectively before and during the placement of a solid load inside the founding furnace.
Figure 11:
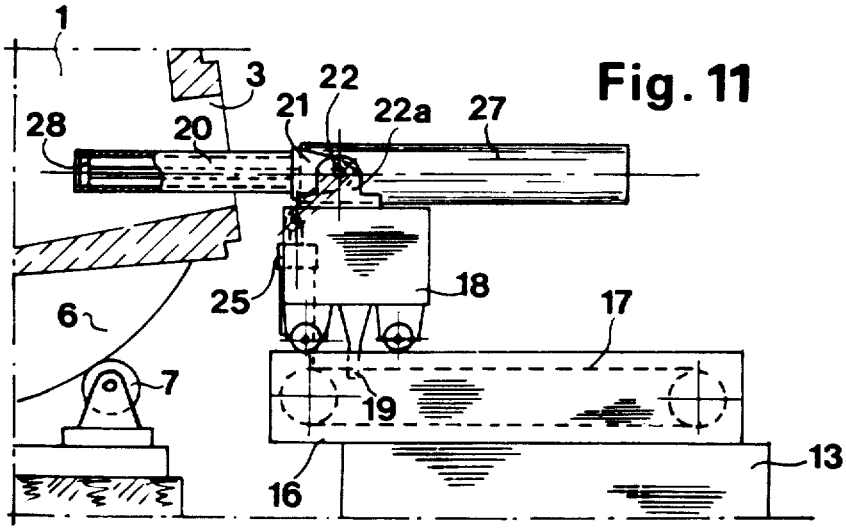

For the sake of clarity, in FIGS. 12 and 13, the solid loading devices for putting solid loads into the furnace is not depicted while in FIGS. 9, 10 and 11, the liquid loading device L is not depicted.

Operation

In order to mold a part in mold 5 of a metal alloy that undergoes high oxidation in the liquid state, for instance refractory steel or high alloy steel with good mechanical resistance, it is necessary to cast the alloy at about 1,000° C. and even higher. An example of the composition of such an alloy is:

carbon: about 0.4%
chromium: about 23%
nickel: about 30%
maganese: about 1.5%
silicon: about 2%
tungsten: about 1.75% iron: about 41% plus the usual amount of impurities.

The solid load of the furnace 1 must include the following most oxidative compounds when they are in a liquid state, which are included in the previously mentioned composition: chromium, carbon and wholly or partially maganese, silicon and tungsten. This solid load must be introduced into the furnace 1 with the solid loading device S. The solid load represents a weight percentage of the overall solid and liquid load of from 26 to 29% in order to obtain the previously mentioned alloy.

The liquid load of the furnace 1 constitutes the remainder of the previously mentioned alloy composition after the solid load is separated from it. Therefore this liquid load possesses a weight percentage of the overall solid and liquid load of from 71 to 74%.

Then, in order to load the founding furnace 1 with an overall load of 500 kg divided between a 370 kg liquid load and a 130 kg solid load, the following steps are executed.

1. Transfer carrier in the withdrawn position

The transfer carrier 13 in this step is left in a withdrawn position located away from the loading orifice 3 of the founding furnace 1. This is the position which is depicted by dotted lines in FIG. 7. In this position, the transfer carrier 13 completely clears the loading orifice 3 and permits all monitoring and maintenance operations that pertain to this section of the founding furnace 1 to be performed. In this position, no solid or liquid load preparation or furnace placement operation can take place. In the withdrawn position, denoted as a in FIG. 7, the trough 31 of the liquid loading device L is also contracted or withdrawn position below the spillway 30, as shown in FIG. 12. The channel 20 of the solid loading device is also in a horizontally withdrawn position, as shown in FIG. 10, with the secondary car 18 supporting the channel 20 being in the position furthest removed from the loading orifice 3 of the furnace 1 which, at this time, is sealed by a cover as shown in FIG. 12. The withdrawn position both of the liquid and solid loading devices makes it possible for the transfer carrier 13 to move along the tracks 14 so as to bring in turn the liquid loading device L and the solid loading device S next to the loading orifice 3.

2. Liquid loading of the founding furnace.

The transfer carrier 13 rolls on the tracks 14 from the withdrawn position as shown by dotted lines in FIG. 7 to the work position c shown in FIG. 6. When the vertical symmetry plane of the casting channel or trough 31, still in a contracted position, coincides with that of the loading orifice 3 of the founding furnace 1 (from which the cover has been removed), the jack 33 moves the second secondary car 32 carrying the trough 31 along the second car 29. As a result, the open and free end of the trough 31 penetrates the loading orifice 3 and enters deep inside the founding furnace 1. Then, the liquid load is poured from the outer ladle P into the spillway 30 from which it spills into the casting trough 31 because of the descending slope and this liquid load then spills inside the founding furnace 1.

In order to shelter the liquid load from oxidation through contact with the atmosphere, the open or free end of the casting trough 31 penetrates deeply inside the furnace 1. When the desired amount of liquid load, a 370 kg load in this example, has been thus introduced inside the furnace 1, the second secondary car 32 moves in the reverse direction to remove the channel 31 from inside the furnace and to bring it back to the contracted or withdrawn position below the spillway 30, shown in FIG. 12.

Then the furnace 1 is sealed by covering the orifice 3.

3. Solid loading of the founding furnace

The liquid and solid loading devices L and S are both in the withdrawn or contracted position, shown in FIG. 7. Then, the transfer carrier 13 is moved to remove the liquid loading device L from the loading zone of the orifice 3 of the founding furnace 1 and to bring the solid loading device S into that zone, i.e., the vertical symmetry plane of the loading channel 20 is brought to coincide with the vertical symmetry plane of the orifice 3, as shown by position b in FIGS. 3 and 8.

Then the jack 25 rotates the loading channel 20 and its pusher jack 27 into a nearly vertical position so as to bring the open end of the loading channel 20 below the static loading hopper 15, as shown in FIGS. 5 and 9. Thereafter, the solid load is spilled from the hopper 15 into the loading channel 20 which together with the pusher 28 is a vertical receptacle with a bottom 28 that receives the solid load in position b. When all of the solid load has fallen into the loading channel 20, the jack 25 actuates the crank 23 so as to bring the loading channel 20 and its pusher-equipped 28 jack 25 back into a more or less horizontal position or one that is slightly sloped, as shown in FIGS. 3 and 10. Then the motor M1 is driven so that the chains 17 engage the secondary car 18 to move towards the loading orifice 3 of the furnace. As a result, the loading channel 20 penetrates inside the furnace 1, as deeply as possible. Once the penetration position, shown in FIGS. 8 and 11, is obtained, the motor M1 stops, thereby halting the advance of the secondary car 18. The jack 27 then is actuated so that its pusher 28 moves inside the loading channel 20 and pushes all of its solid content into the furnace 1. The solid load falls into the already introduced liquid load in which it is quickly submerged, thoroughly sheltered from the outside oxidizing atmosphere.

When the pusher 28 has travelled the entire length of the loading channel 20 and the entire solid load has been placed inside the furnace 1, the jack 27 is moved in the opposite direction so as to move the pusher 28 backwards to the upward end of the loading channel 20, thus once again becoming its bottom. Then the motor M1 is driven in the opposite direction so that the chains 17 withdraw the secondary car 18 and removes its loading channel 20 from the furnace 1. The open end of the loading channel exits the orifice 3 and resumes its withdrawn or contracted position as shown in FIGS. 6 and 10.

The orifice 3 is sealed with a cover and the founding furnace 1 melts the entire solid load both with heat supplied by the graphite rod 2 and by the initial liquid load.

When the overall 500 kg load has been founded, a mold 5 is applied in sealed fashion onto the casting orifice of the casting channel 4 of the furnace 1 and the furnace 1 is tilted until the end of its casting channel 4 rests, with the weight of the mold 5, on the crutch 12. An inert gas under pressure is introduced by way of the duct 8 so as to fill the mold 5. After the mold 5 is filled and the alloy has solidified inside the mold 5, pressure from the inert gas is decreased so that the liquid metal level drops below that of the orifice of the casting channel 4. The mold 5 is evacuated and replaced by another mold 5. Pressure is exerted anew through duct 8, inside the furnace 1, so that the new mold 5 is filled with metal alloy. When the filling operation is performed and the metal alloy has had time to solidify inside the mold 5, pressure is again reduced inside the duct 8 to make the surplus of liquid metal alloy drop inside the channel 4, and the second mold 5 is evacuated and replaced by a third mold 5. These operations are repeated until the metal alloy load contained in the furnace 1 is almost exhausted. A residual bottom or stand of the bath can be left inside the furnace 1 before triggering a new cycle whereby a liquid load is placed in the furnace followed by one or more solid loads. Hence, a number of molds 5 can be cast and then, when the capacity of the furnace is almost exhausted, the furnace 1 is tilted into the position where the channel 4 is lifted to a rising slope so as to keep the channel 4 empty and to prepare the furnace 1 for a new load.

We claim:

1. A loader for a founding furnace, comprising:
transfer carrier (13) which is mobile in a direction perpendicular to the axis (XX) of solid and liquid load introduction through a loading orifice (3) of said furnace (1);
a liquid loading device (L) with a channel (31) for introducing the liquid load mounted on said carrier parallel with said axis; and
a solid loading device (S) with a channel (20) for introducing the solid load through said orifice, mounted on said carrier parallel and to the side of said liquid loading device (L), wherein each of said channels (31, 20) is mobile in a translational motion that is parallel to said axis.

2. A loader, as recited in claim 1, wherein said liquid loading device (L) includes a static spillway (30) and a mobile element that is comprised of a casting channel (31), said spillway (30) being placed above said casting channel (31) and affixed to said transfer carrier (13).

3. A loader, as recited in claim 1, further comprising:
a track (14) orthogonal to said axis (XX) on which said transfer carrier moves; and
wherein said liquid loading device (L) further comprises:
a secondary car (32) movable parallel to said axis; and
a telescopic channel (31) borne by said secondary car.

4. A loader, as recited in claim 1, wherein said solid loading device (S) comprises:
a static hopper (15); and
a mobile channel (20) located below said hopper tiltable between a substantially vertical position to receive said solid load coming from said hopper (15) and an approximately horizontal position for transferring said received solid load into said furnace (1) through the loading orifice (3).

5. A loader as recited in claim 1, further comprising:
a track (14) orthogonal to said axis (XX) on which said transfer carrier moves; and
wherein said solid loading device comprises a mobile secondary car (18) mounted on said transfer carrier (13) and movable parallel to said axis, said channel (20) being borne on said secondary car.

6. A loader, as recited in claim 1, where said solid loading device (S) comprises an axial pusher (28) that comprises the bottom of the loading channel (20) and is movable therethrough and a jack (27) for moving said pusher and wherein the other end of said channel (20) is freely open.

7. A loader, as recited in claim 6, wherein said loading channel (20) has a closed crosswise profile which corresponds to that of said pusher (28), said pusher (28) being movable inside the channel (20) along substantially its entire length.

8. A loader, as recited in claim 4, wherein said solid loading device (S) further comprises a pusher (28) movable within said channel, a jack (27) for moving said pusher, and a spindle (22), wherein said channel and said jack are rotatable on said spindle between a nearly vertical position for receiving said solid load coming from said hopper (15) and an approximately horizontal position for loading said solid load into the furnace (1) through the loading orifice (3).

9. A loader, as recited in claim 8 wherein said solid loading device (S) further comprises a crank (23) and a piston arm (24) for rotating said channel and said jack about said spindle.

* * * * *